United States Patent [19]

Nishio

[11] Patent Number: 4,508,332

[45] Date of Patent: Apr. 2, 1985

[54] SHEET FEEDER FOR COPYING MACHINES

[75] Inventor: Tadashi Nishio, Hachioji, Japan

[73] Assignee: Olympus Optical Co., Ltd., Japan

[21] Appl. No.: 440,290

[22] Filed: Nov. 9, 1982

[30] Foreign Application Priority Data

Dec. 5, 1981 [JP] Japan ..... 56-195120

[51] Int. Cl.[3] ..... B65H 3/06

[52] U.S. Cl. ..... 271/118; 271/127; 271/260

[58] Field of Search ..... 271/118, 117, 127, 126, 271/160, 170, 171, 242, 152, 153, 154, 155, 156, 10

[56] References Cited

U.S. PATENT DOCUMENTS

| | | | |
|---|---|---|---|
| 4,025,187 | 5/1977 | Taylor et al. | 271/10 |
| 4,221,376 | 9/1980 | Handen et al. | 271/149 |
| 4,319,742 | 3/1982 | Ulseth | 271/118 |

OTHER PUBLICATIONS

Baumann, G. W. et al., "System for Minimizing Solenoid Requirements", *IBM Technical Disclosure Bulletin*, vol. 24, No. 7B, Dec. 1981, p. 3763.

*Primary Examiner*—Bruce H. Stoner, Jr.
*Assistant Examiner*—John A. Carroll
*Attorney, Agent, or Firm*—Ostrolenk, Faber, Gerb & Soffen

[57] ABSTRACT

A sheet feeder is adapted to feed sheets, received in a stack within a sheet cassette, one by one by a feed roller which rocks in response to a feed signal. The sheet feeder includes a detecting member for detecting the number of sheets left within the cassette, and means responsive to a signal from the detecting member for controlling the timing when the feed signal is produced. In this manner, an amount of flexure produced in the sheet being fed before it reaches resistor rollers is maintained constant.

33 Claims, 17 Drawing Figures

SHEET FEEDER FOR COPYING MACHINES

BACKGROUND OF THE INVENTION

The invention relates to a sheet feeder which feeds sheets, received in a stack within a sheet cassette, one by one to a copying machine, a printing machine or the like (hereafter collectively referred to as a copying machine) by the action of a feed roller which oscillates in response to a feed signal, and more particularly, to such sheet feeder which is adapted to produce a given amount of flexure in the sheet as it is fed from the cassette and before it reaches register rollers.

A conventional sheet feeder as used in a copying machine is constructed in a manner as illustrated in FIG. 1, for example. Specifically, a copying machine includes a loading station 10 which receives a sheet cassette 1 having a number of sheets 2 disposed therein in a stack. It is to be understood that the sheets 2 in the stack are upwardly urged by a bottom plate 3, as formed by a leaf spring, which is disposed in the bottom within the cassette 1, whereby an uppermost one of the sheets 2 has its upper surface engaged and retained by separation claws 8 while a feed roller 6 moving toward an opening 1*a*, formed in the top panel of the cassette 1 toward the front end thereof, feeds the uppermost sheet out of the cassette 1. As shown, the feed roller 6 is rotatably mounted on a pin 5 secured to the free end of an arm 4 which is in turn mounted on a shaft 7 in a rockable manner. A drive mechanism, not shown, causes the roller to rotate in a direction to feed the sheet. The sheet 2 delivered out of the cassette 1 by the action of the feed roller 6 is guided by a pair of guide plates 9*a*, 9*b* toward a nip between register rollers 11.

In a conventional sheet feeder constructed in a manner as mentioned above, a feed signal applied causes the arm 4 to move down until the feed roller 6 engages the upper surface of the sheet 2. Thereupon, the force of friction acting between the rotating roller 6 and the sheet 2, combined with the action of the separation claws 8, causes the uppermost sheet 2 to be driven forward past the separation claws 8, whereby such sheet moves along the guide plates 9*a*, 9*b* until its leading end reaches the register rollers 11 which then remain stationary. During the time the arm 4 remains at its lower position for a given time interval, the roller 6 continues to feed the sheet, whereby the uppermost sheet 2 which has its leading end held in abutment against the register rollers 11 will be flexed upward, as shown in phantom line in FIGS. 1 and 2, on the lower guide plate 9*a*. When the arm 4 returns to its upper position after the given time has passed since the feed signal has been initially applied, the feed roller 6 moves away from the sheet surface, whereby the feeding operation of the sheet 2 is terminated. Subsequently, when a drive signal is applied to the register rollers 11 to cause rotation thereof during the time the roller 6 continues its feeding operation, the sheet is fed into the interior of the copying machine.

In the conventional sheet feeder constructed in the manner mentioned above, it will be seen that there is a great difference in the amount of flexure formed in the sheet being delivered when the leading end thereof is held in abutment against the register rollers 11, between when the cassette 1 is full of fresh sheets 2 and when the stack contains a few last sheets, as shown in FIG. 3. The greater the depth of the cassette 1, the greater will be the magnitude of such difference. Such flexure is indicated at 2*a* and is effective to build up a force to drive the sheet 2 forward, which may be utilized when feeding the sheet 2 into the copying machine through the register rollers 11. Accordingly, if the amount of flexure is excessively low, the sheet will be urged against the register rollers 11 with a reduced force, thereby causing a likelihood that a lag in the feed operation may result. Conversely, if the amount of flexure is excessively high, the flexure 2*a* will be formed at two locations, namely, in the form of a peak and valley as shown in FIG. 4. In this instance, the force to drive the sheet 2 forward will be lost, degrading the mating relationship with the register rollers 11 to increase the likelihood of producing a lag in the feed operation.

It will be seen that such a varying amount of flexure produced in the sheet 2 results from the fact that the downward movement of the feed roller 6 is always initiated at a given timing independently from the number of sheets left in the stack within the cassette 1. Referring to FIG. 5 which illustrates the point of contact of the roller 6 with the sheet 2, it will be noted that the location of the upper surface of the uppermost one of the sheets 2 in the stack when the cassette 2 is full of sheets is indicated by a line A while the location of the surface of the uppermost one of sheet 2 in the stack when only a few sheets are left within the cassette is indicated by a line B. It will be apparent from FIG. 5 that a point of contact a between the roller 6 and the sheet 2 for the full stack is displaced from a point of contact b for the nearly exhausted stack by a vertical distance $\delta$. Accordingly, the sheet which begins to be fed from the point b will be fed by a length which is less than the corresponding length of the sheet which begins to be fed from the point a, by an amount corresponding to a time interval required for the movement through the vertical distance $\delta$. As a consequence, the amount of flexure formed in the sheet 2 after the leading end of the sheet 2 abuts against the register rollers 11 is reduced. The magnitude of the vertical distance $\delta$ increases with an increasing sheet capacity of the stack, causing an increasing difference in the amount of flexure between the full stack and the nearly exhausted stack, giving rise to the likelihood that a lag in the feed operation by the register rollers 11 may result.

SUMMARY OF THE INVENTION

It is an object of the invention to provide a sheet feeder for copying machines in which the sheet stack condition within a cassette is detected to adjust the timing to produce a feed signal in a corresponding manner.

In accordance with the invention, there is provided means for detecting a number of sheets stacked within a cassette, and means for controlling the timing when a feed signal is produced. The timing when the feed signal is produced to drive the feed roller is adjusted in accordance with the number of sheets left in the stack. Accordingly, substantially a given amount of flexure can be produced in a sheet which has its leading end abutting against register rollers, independently from the number of sheets left within the cassette. This assures a stable feed operation by the register rollers. In this manner, the occurrence of a lag in the feed operation as may be experienced in a conventional sheet feeder is avoided.

DESCRIPTION OF PREFERRED EMBODIMENTS

Figure 1:
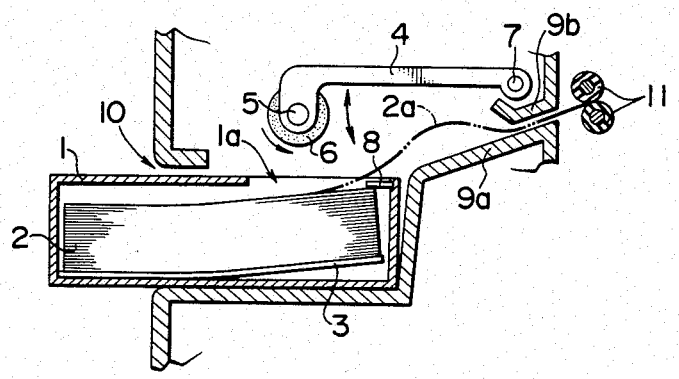
FIG. 1 (PRIOR ART)
FIG. 1 is a fragmentary cross section of a conventional sheet feeder.
Figure 2:
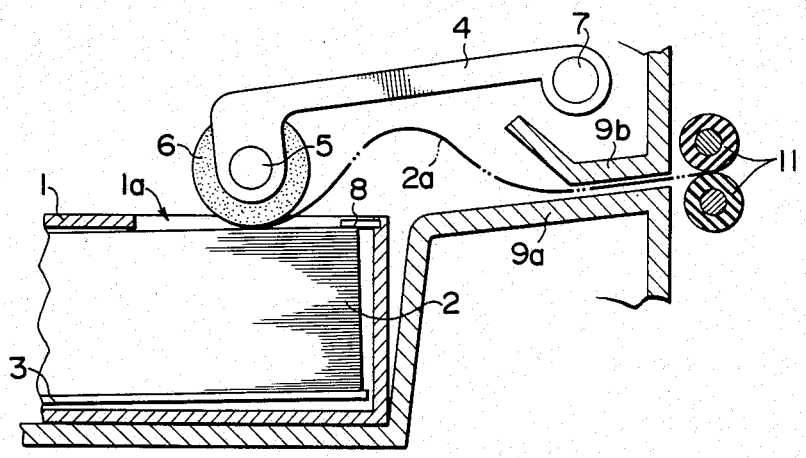
FIG. 2 (PRIOR ART)
FIG. 2 is a fragmentary, enlarged cross section of the sheet feeder shown in FIG. 1 when a cassette is full of sheets.
Figure 3:
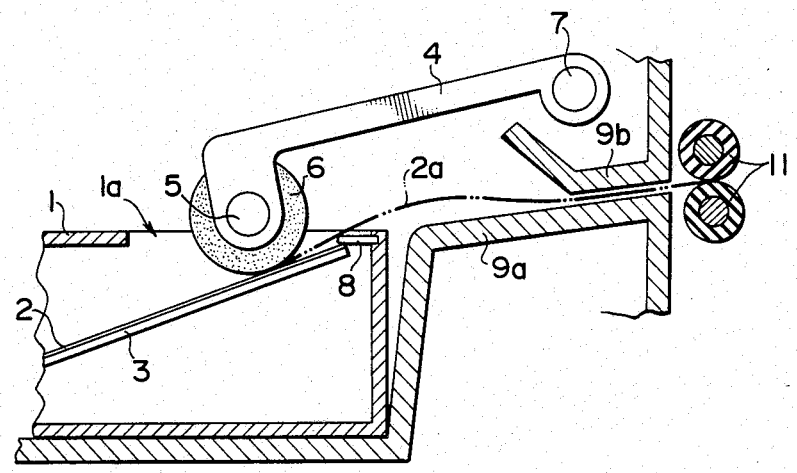
FIG. 3 (PRIOR ART)
FIG. 3 is a fragmentary, enlarged cross section of the feeder when only a few sheets are left in the cassette.
Figure 4:
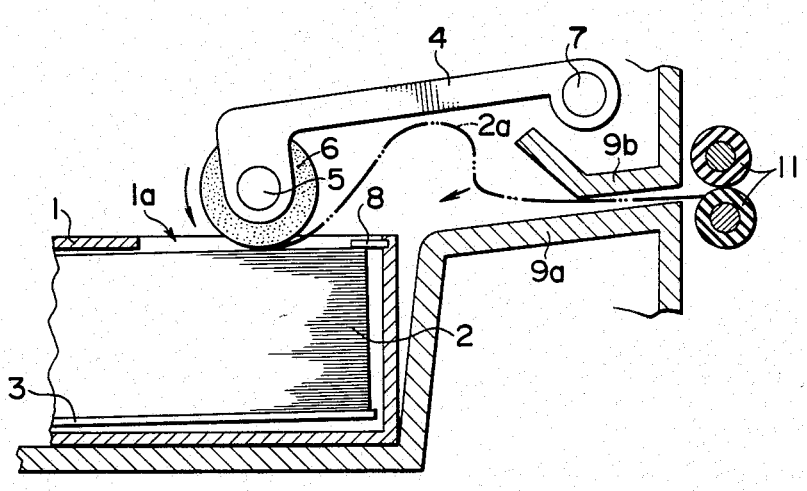
FIG. 4 (PRIOR ART)
FIG. 4 is a similar fragmentary cross section of the sheet feeder shown in FIG. 1, illustrating the result caused by an excessive degree of feed operation.
Figure 5:
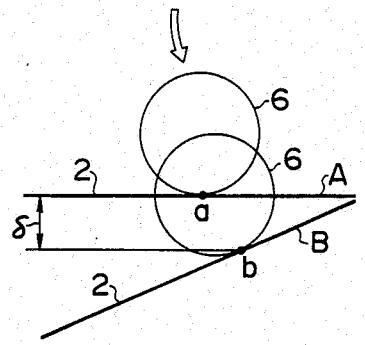
FIG. 5 is a schematic view for explaining the difficulty experienced with the sheet feeder of FIG. 1.
Figure 6:
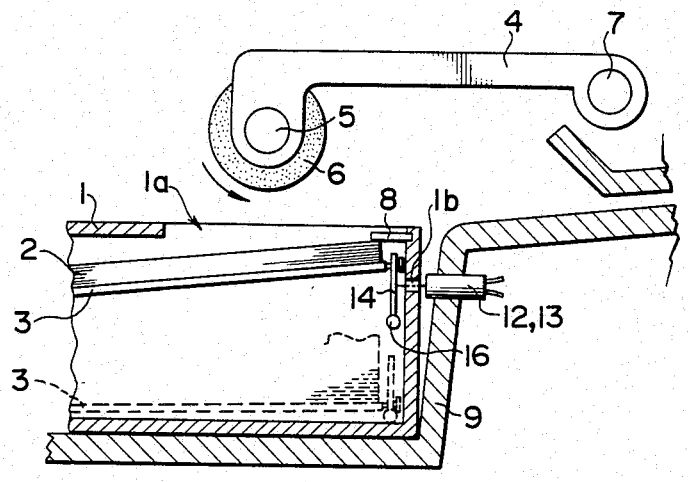
FIG. 6 is a fragmentary, enlarged cross section of a sheet feeder according to a first embodiment of the invention.
Figure 7:
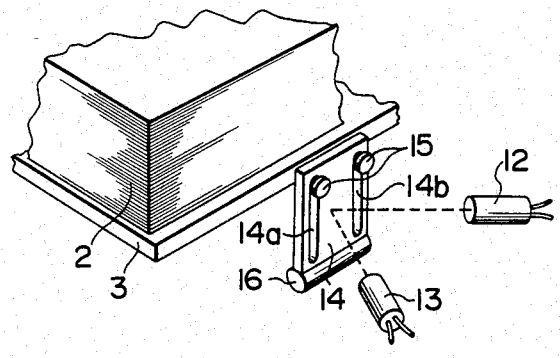
FIG. 7 is a fragmentary perspective view of the sheet feeder shown in FIG. 6.

Referring to FIGS. 6 and 7, there is shown a sheet feeder according to a first embodiment of the invention in fragmentary, enlarged cross section and fragmentary perspective view.

In the description to follow, it is to be noted that parts constructed in similar manner as those used in a conventional sheet feeder shown in FIGS. 1 to 4 are designated by like reference characters, and their construction and operation will not be described.

Referring to FIGS. 6 and 7, there is shown a bottom plate 3 formed by a leaf spring and disposed within the bottom of a sheet cassette 1 and on which a stack of sheets is placed. The bottom plate 3 is urged upward, and a vertically movable light reflecting plate 14 is secured to the edge of the bottom plate by fastener members 15 such as pins. The plate 14 is rectangular in configuration, and is formed with a pair of vertically elongate slots **14*a*, 14*b* along its both lateral sides, which extend in a direction parallel to the direction of movement of the bottom plate 3. The fastener members 15 extend through the slots 14*a*, 14*b* to be secured to the edge face of the bottom plate 3, whereby the plate 14 is movable relative to the bottom plate 3**.

A copying machine in which a loading station to receive the cassette is formed includes a vertical wall 9, and a light emitting element 12 such as light emitting diode and a light receiving element 13 such as photoelectric transducer element are disposed to extend through the wall 9 at a common level toward the top end of the wall. Light projected by the element 12 passes through a hole **1*b* formed in the cassette 1 to be projected into the cassette 1. When the light reflecting plate 14 is disposed within the light path, it reflects such light, which then passes through the hole 1*b* to be incident on the light receiving element 13. A weight 16 is secured to the lower end of the plate 14 to urge it downward in order to maintain it in upright position so that the plane of the plate 14 is orthogonal to the plane in which the both elements 12, 13** are disposed.

When the cassette 1 is full of sheets 2, the fastener members 15 will be located at the lowermost ends of the slots **14*a*, 14*b* formed in the plate 14, as indicated in dotted line in FIG. 6, to support the plate 14. At this time, the element 13 fails to detect any light from the element 12 which is reflected. Accordingly, a feed signal can be produced in a manner to indicate that an increased number of sheets are present within the cassette. Such feed signal is produced at a delayed timing as compared with a corresponding signal produced when the stack contains a reduced number of sheets. The lagging feed signal initiates a feed operation by causing a downward movement of the feed roller 6. As the number of sheets within the stack decreases, the fastener members 15 moves upward within the slots 14*a*, 14*b* until a solid line position in FIG. 6 is reached when only a few sheets are left within the cassette and the members are located at the upper end of the slots to carry the plate 14. Light projected by the element 12 is then reflected by the plate 14 to be incident on the element 13, which is therefore capable of producing a feed signal indicating that a reduced number of sheets are left within the cassette. The feed signal then initiates a feed operation by causing a downward movement of the feed roller 6. The weight 16 secured to the lower end of the plate 14 to urge it downward avoids the likelihood of causing a malfunctioning as a result of a jamming of fastener members 15 within the slots 14*a*, 14*b* to cause the plate 14 to be raised to the level of the element 12** even though there is an increased number of sheets within the cassette.

Figure 8:
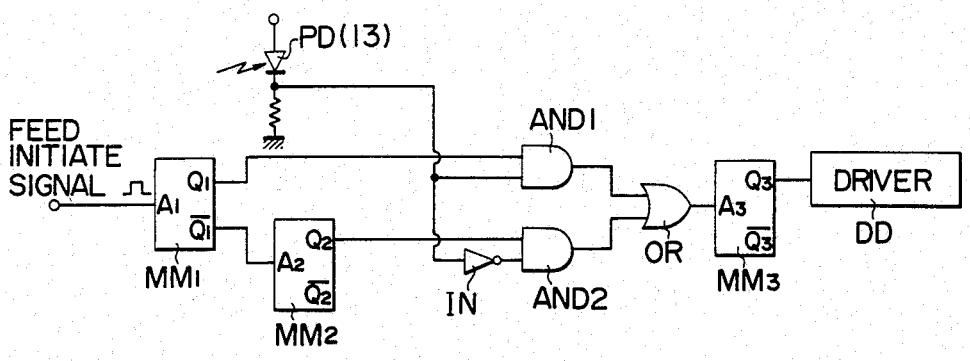
FIG. 8 is a circuit diagram of a control circuit associated with the sheet feeder shown in FIG. 6.

FIG. 8 shows a control circuit which controls the rocking motion of the feed roller 6. As shown, the control circuit comprises a first monostable multivibrator MM1 which receives a feed initiate signal as an input, a second monostable multivibrator MM2 which receives the inversion of an output signal from the first multivibrator MM1 as an input, a first AND gate AND1 receiving as inputs a first feed signal output from the first multivibrator MM1 and an output signal from the element 13 which is shown as a photoelectric transducer element PD, a second AND gate AND2 receiving the inversion of an output signal from the element 13, as formed by an inverter IN, and an output signal from the second multivibrator MM2 as inputs, an OR gate OR receiving output signals from both AND gates and feeding its output signal to a third monostable multivibrator MM3, and a driver circuit DD receiving an output signal from the multivibrator MM3 as an input and causing a rocking motion of the feed roller 6. The first feed signal is produced concurrently with the application of the feed initiate signal while the second feed signal is produced in delayed relationship with the first feed signal. The driver circuit operates in response to either feed signal.

Figure 9:
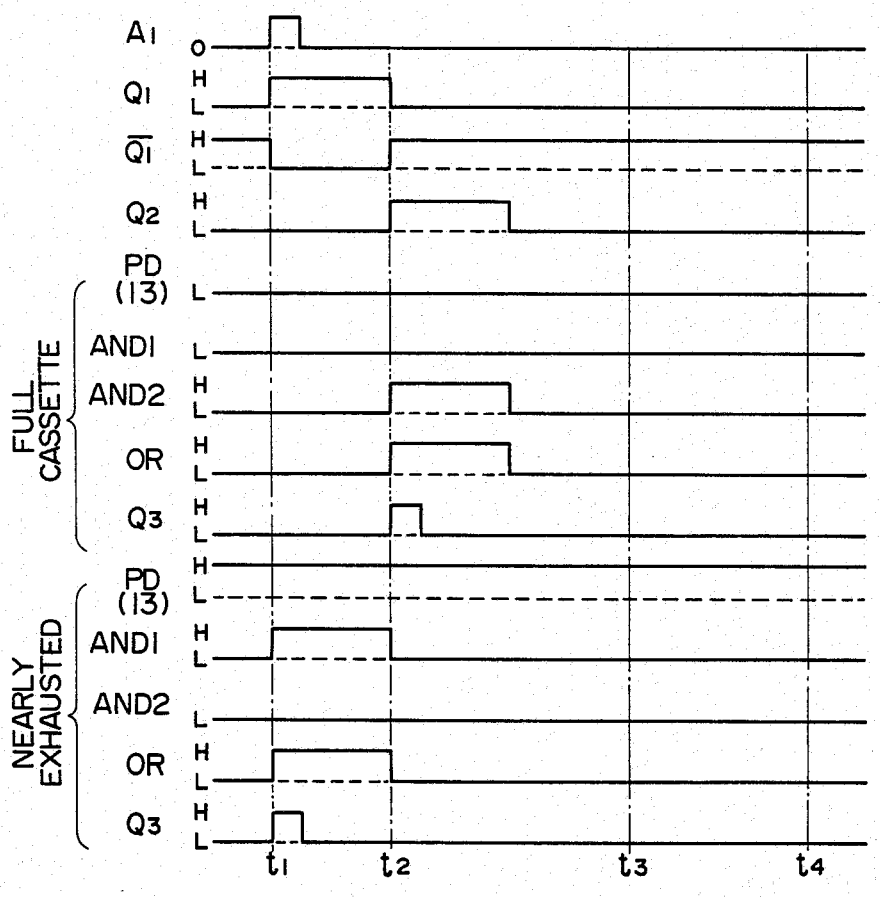
FIG. 9 graphically shows a series of timing charts which illustrate the operation of the control circuit of FIG. 8.

The operation of the control circuit will be described with reference to a series of timing charts shown in FIG. 9. In the description to follow, an output signal of high level is referred to as H signal while an output signal of low level is referred to as L signal. It is also assumed that the feed initiate signal is produced at time $t_1$. When the feed initiate signal is applied to the first multivibrator MM1, its output terminal $Q_1$ produces H signal while output terminal $\overline{Q}_1$ produces L signal. The L signal from the output terminal $\overline{Q}_1$ is fed to the second multivibrator MM2, which produces H signal at its output terminal $Q_2$ at time $t_2$ when the L signal changes from L to H level. Accordingly, there is a time difference of $(t_2-t_1)$ between the H signals produced at the output terminals $Q_1$ and $Q_2$ of the first and the second multivibrator MM1, MM2. A detector including the element 13 produces H signal only when it has sensed the reflected light. Accordingly, when the cassette contains a reduced number of sheets, the detector produces H signal, which is fed to the first AND gate AND1 together with H signal from the output terminal $Q_1$, and thence fed through OR circuit OR to the input of the third multivibrator MM3, the output terminal $Q_3$ of which produces H signal at time $t_1$ on, which is fed to the driver circuit DD for a given time interval. In this manner, the feed roller 6 operates to feed a sheet. Conversely, when the light receiving element 13 fails to detect any reflected light or when the cassette contains a maximum number of sheets, the element 13 produces L signal, which is then inverted into H signal by the inverter IN and passes through the second AND gate AND2 at time $t_2$ when it is enabled by H signal from the output terminal $Q_2$, and thence fed to the third multivibrator MM3. The multivibrator MM3 produces H signal at its output terminal $Q_3$ for a given time interval from time $t_2$ on, and this signal is fed to the driver circuit DD to initiate a feed operation. It will thus be seen that the feed signal fed to the third multivibrator MM3 will be either output signal at the terminal $Q_1$ which occurs at time $t_1$ or the output signal at the terminal $Q_2$ which occurs at time $t_2$, depending on whether or not the element 13 has detected reflected light. Since there is a time difference of $(t_2-t_1)$ between the both output signals as mentioned previously, the time to initiate downward movement of the feed roller 6 may be changed in accordance with the number of sheets 2 within the cassette.

Thus, the control circuit permits the rocking motion of the feed roller 6 to be initiated at time $t_1$ when the cassette contains a reduced number of sheets, and to be initiated at time $t_2$, which is delayed with respect to time $t_1$, when the cassette is full of sheets. Accordingly, when the sheet is full of sheets, the feeding action applied to the uppermost sheet can be reduced by an amount corresponding to the time difference of $(t_2-t_1)$ as compared with the prior art, thus achieving an adjustment to maintain a constant amount of flexure. On the other hand, the register rollers 11 are always operated at time $t_4$ which follows times $t_1$, $t_2$. It will therefore be seen that if the delayed time $t_2$ occurs after a given time $t_3$, the register rollers 11 begin to rotate before the leading end of the sheet 2 reaches them, so that the time $t_2$ must be chosen between times $t_1$ and $t_3$.

Figure 10:
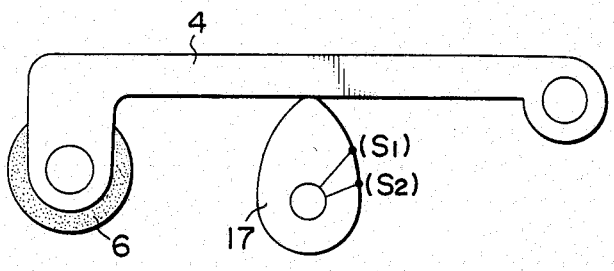
FIG. 10 is a side elevation of one form of arm drive means which may be used in the sheet feeder of FIG. 6.

Means which causes a downward movement of the feed roller 6 in response to the feed signal which occurs at time $t_1$ or $t_2$ may comprise a solenoid, a combination of a motor and a cam or the like. Where a solenoid is used to cause a vertical movement of the feed roller 6, it may operate to respond to the feed signal occurring at time $t_1$ when the cassette has a few sheets or time $t_2$ when the cassette is full of sheets, by causing a downward movement of the arm 4 to bring the feed roller 6 into abutment against the surface of the sheet 2, followed by raising the feed roller 6 immediately after time $t_4$ when the register rollers 11 begin to rotate. In this manner, there can be produced a constant amount of flexure in the sheet when the cassette is full of sheets or when it has a reduced number of sheets. With an arrangement utilizing a motor drive through a cam, a cam 17 is utilized to move the arm 4 up and down as illustrated in FIG. 10. When the cassette is full of sheets, the feed roller 6 will contact the surface of the sheet 2 at point $S_1$, which preceeds a corresponding point $S_2$ when the cassette contains a reduced number of sheets. In other words, the feed roller will operate to feed the sheet for an increased length of time as compared when the sheet contains a reduced number of sheets. Consequently, the degree of feed operation applied prior to the initiation of rotation of the register rollers can be made uniform if the feed signal is produced at a later point in time when the cassette is full than when the cassette contains a reduced number of sheets. In this manner, there can be produced a constant amount of flexure in the sheet, independently from whether the cassette is full or contains a reduced number of sheets.

Figure 11:
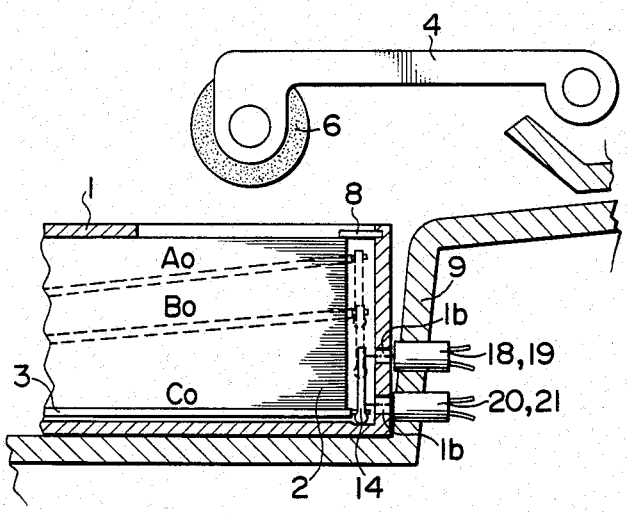
FIG. 11 is a fragmentary, enlarged cross section of a sheet feeder according to a second embodiment of the invention.

FIG. 11 shows a second embodiment in which two pairs of light emitting elements and light receiving elements are employed to change the timing when the operation of the feed roller 6 is initiated in three steps in accordance with the number of sheets in the stack within the cassette 1. Specifically, light emitting elements 18, 20 and light receiving elements 19, 21 are mounted in the wall of the cassette loading station 10 of the copying machine so as to lie in separate horizontal planes. The light reflecting plate 14 moves up and down in accordance with the number of sheets placed on top of the bottom plate 3, in the similar manner as described above in connection with the first embodiment. When the cassette is full of sheets, the bottom plate 3 assumes its position $C_O$ wherein the plate 14 is located opposite to each set of elements 18, 20 and elements 19, 21. This permits a detection of the fact that the cassette 1 is full of sheets, and a downward movement of the feed roller 6 is initiated at a corresponding timing. When the bottom plate 3 assumes its position $B_O$, only the set of elements 18, 19 are located opposite to the plate 14, whereby a detection is made that the cassette contains a medium number of sheets therein. Accordingly, the timing when the downward movement of the feed roller 6 is initiated is made earlier than the timing used when the cassette is full. In this manner, the amount of flexure formed in the sheet is made substantially uniform when the bottom plate assumes its positions $C_O$ and $B_O$. As the number of sheets in the cassette is further reduced and the bottom plate 3 assumes its position $A_O$, neither set of elements is located opposite to the plate 14. This results in the detection of the fact that the cassette contains a very few number of sheets, and the timing to initiate the downward movement of the feed roller 6 is further advanced in time, so as to produce the same amount of flexure as when the cassette is full or it contains an intermediate number of sheets.

While in the second embodiment illustrated in FIG. 11, the two sets of light emitting and light receiving elements 18, 19 and 20, 21 are disposed in the vertical wall 9 of the copying machine, which defines a cassette loading station, toward the bottom thereof so that the light reflecting plate 14 is effective to detect when the cassette is full of sheets and when it contains an intermediate number of sheets. However, the reception of reflected light will be more reliable, by preventing a tilting of the light reflecting plate 14, when the two sets of elements 18 to 21 are disposed in the vertical wall 9 toward the top end thereof, as in the first embodiment.

Figure 12:
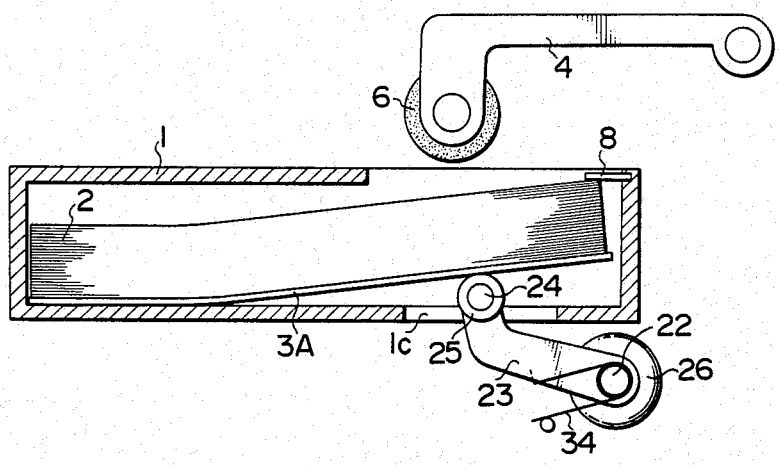
FIG. 12 is a fragmentary cross section of a sheet feeder according to a third embodiment of the invention.
Figure 13:
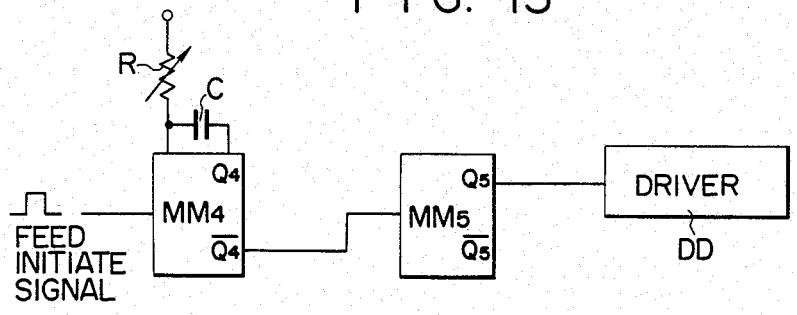
FIG. 13 is a circuit diagram of a control circuit associated with the sheet feeder of FIG. 12.
Figure 14:
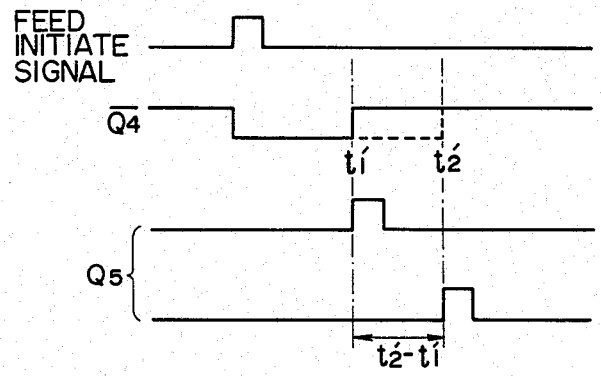
FIG. 14 graphically shows several timing charts which illustrate the operation of the control circuit shown in FIG. 13.

FIG. 12 is a fragmentary cross section of a third embodiment of the invention. FIG. 13 is a circuit diagram of a control circuit associated with the third embodiment while FIG. 14 graphically shows timing charts which illustrate the operation of the control circuit. A sheet cassette 1 includes a bottom plate 3A which carries a stack of sheets thereon. It may comprise a leaf spring as in previous embodiments, or may comprise a plain plate. An arm 23 is fixedly mounted on a pin 22 which is pivotally mounted on the copying machine, and is urged upward as by spring 34. The free end of the arm 23 carries a shaft 24 on which a roller 25 is mounted. An opening 1c is formed in the bottom of the cassette 1, and hence the roller 25 is urged against the bottom plate 3A. When the bottom plate 3A comprises a leaf spring, the roller 25 is arranged to follow the movement of the bottom plate 3A. On the contrary, when the bottom plate 3A comprises a plain plate, an arrangement is made so that the arm 23 is effective to raise the bottom plate 3A upward through the action of the roller 25. It is to be noted that a variable resistor 26 is mounted on the pin 22 so as to exhibit a resistance which varies with the angle of rotation of the arm 23. It will be seen that the arm 23 moves angularly in accordance with the number of sheets in the stack, thus changing the angle of rotation of the pin 22, whereby the resistance of the resistor 26 varies in accordance with the number of sheets 2. The resistor 26 is used as a resistor R in an integrating circuit associated with a first monostable multivibrator MM4 of the control circuit (see FIG. 13) which determines its reset time, thereby allowing the initiation of the downward movement of the feed roller 6 to be controlled so as to correspond to the number of sheets in the cassette 1. Specifically, if the cassette contains a reduced number of sheets, the angle of rotation will increase. Conversely, if the cassette has an increased number of sheets, the angle of rotation will be reduced. The variable resistor 26 may be arranged so that its resistance decreases with an increasing angle of rotation. With this arrangement, when the cassette contains a reduced number of sheets, L signal will be produced at the output terminal $\overline{Q}_4$ of a monostable multivibrator MM4 for a short duration after the feed signal is applied thereto, and a rising signal which represents a change from L to H and applied to a second monostable multivibrator MM5 will be produced at time $t_1'$. Conversely, when an increased number of sheets are contained in the stack and the angle of rotation reduces, the resistance increases, whereby L signal from $\overline{Q}_4$ output terminal of the vibrator MM4 will be present for an increased duration, and a drive signal to a drive circuit DD, developed at $Q_5$ output terminal of the vibrator MM5 will be lagging by an amount $(t_2'-t_1')$ with respect to the time $t_1'$ when the angle of rotation is greater. By using the variable resistor 26 in the control circuit, the timing to produce the feed signal can be changed in accordance with the number of sheets, thereby producing substantially uniform amount of flexure in the sheet.

Figure 15:
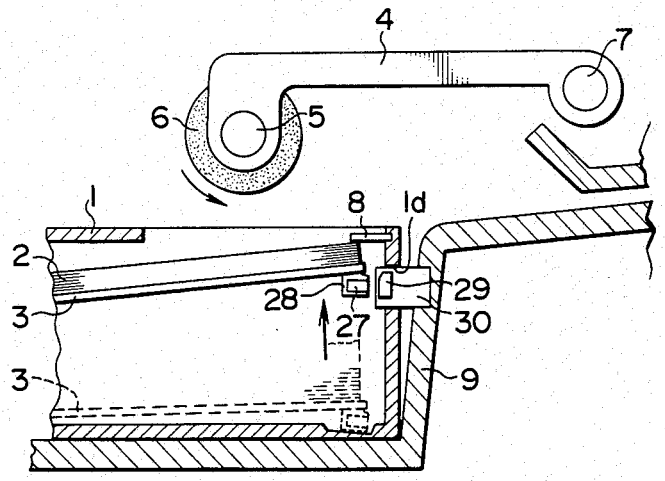
FIG. 15 is a fragmentary, enlarged cross section of a sheet feeder according to a fourth embodiment of the invention.

FIG. 15 shows a fourth embodiment of the invention in which the light reflecting plate and the light emitting and the light receiving element used to detect the number of sheets left in the cassette in the first and the second embodiment are replaced by a combination of a magnet and a magnetic detecting element or Hall IC. Specifically, a magnet 27 is secured, by means of a magnet holder 28, to the bottom surface of the bottom plate 3 toward its inner end within the cassette 1 while Hall IC 29 is disposed in the vertical wall 9 of the cassette loading station within the copying machine toward its top end, by means of a Hall IC holder 30, so as to project toward the path of movement of the magnet 27 within the cassette 1. The inner wall of the cassette 1 is formed with an opening 1d to receive the holder 30 therein so that when the cassette 1 is loaded in place, the holder 30 extends through the opening 1d into the cassette 1 so as to be located opposite to the path of movement of the magnet 27.

The described means for detecting the amount of sheets left in the cassette operates in the similar manner as the first embodiment. A control circuit which is associated with the embodiment of FIG. 15 may be constructed in the similar manner as that shown in FIG. 8 wherein the light receiving element 13 (PD) is replaced by the Hall IC 29. Specifically, when the cassette contains an increased number of sheets, the bottom plate 3 assumes its lower position shown in broken lines in FIG. 15, whereby the magnet 27 is greatly spaced from the Hall IC 29, which is therefore insensitive to the magnet force produced by the magnet 27. At this time, it produces a signal indicative of the fact that the cassette is full of sheets so as to cause the operation of the feed roller 6 to be initiated at a timing which is lagging with respect to the timing of a feed signal produced when the cassette contains a reduced number of sheets. As the number of sheets decreases, the bottom plate 3 moves to its upper position shown in solid line, whereby the magnet 27 is located opposite to the Hall IC 29. Thereupon, the Hall IC 29 is sensitive to the magnet force therefrom to produce a corresponding feed signal to initiate the downward movement of the feed roller 6.

Figure 16:
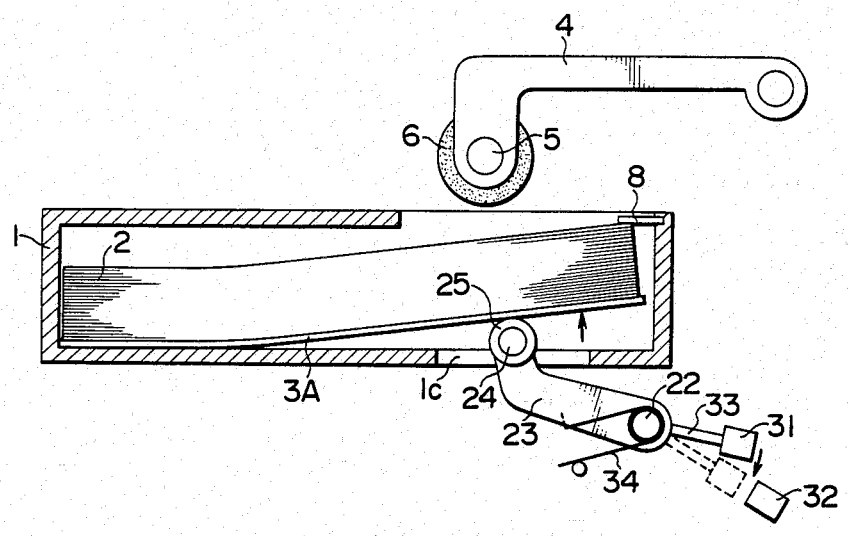
FIG. 16 is a fragmentary cross section of a sheet feeder according to a fifth embodiment of the invention.

FIG. 16 shows a fifth embodiment of the invention, which is substantially similar to the third embodiment shown in FIG. 12. However, rather than utilizing the variable resistor 26, the angle of rotation of the arm 23 is detected by an arrangement including a rocking arm 33 having its one end fixedly mounted on the pin 22 and having a magnet 31 secured to the free end thereof, for cooperation with a magnetic detecting element or reed switch 32 disposed on the copying machine and disposed in opposing relationship with the path of angular movement of the magnet 31. Specifically, the location of the reed switch 32 is chosen so as to be opposite to the location of the magnet 31 assumed when the arm 23 has moved angularly as the bottom plate 3A is raised upward as the number of sheets decreases.

With this arrangement, as the number of sheets in the cassette decreases to a given value and the bottom plate 3A rises upward in a corresponding manner to cause an angular movement of the arm 23, the magnetic force from the magnet 31 is detected by the reed switch 32, which then produces a feed signal to initiate a feeding operation in a manner corresponding to the reduced number of sheets in the cassette. Conversely, when the cassette is full of sheets, the arm 23 rotates through a very small angle, whereby the magnet 31 does not rotate through enough angle to be located opposite to the reed switch 32, which therefore fails to detect the magnetic force therefrom. In this manner, it produces a feed signal in a manner corresponding to the full cassette condition, thereby initiating the downward movement of the feed roller 6 at timing which is lagging with respect to the timing used when the number of sheets in the stack is reduced.

A control circuit which is to be used for the fifth embodiment may be similar to that shown in FIG. 8 except that the light receiving element 13 (PD) is replaced by the reed switch 32. It is to be understood that the reed switch 32 may be replaced by other magnetic detecting element such as Hall IC, for example.

Figure 17:
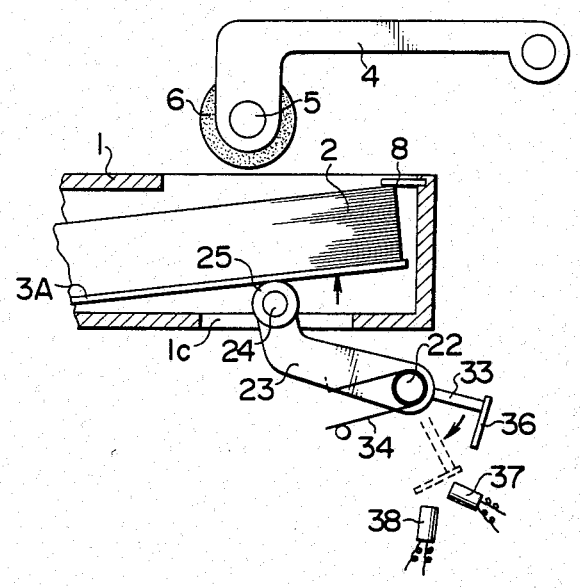
FIG. 17 is a fragmentary cross section of a sheet feeder according to a sixth embodiment of the invention.

FIG. 17 shows a sixth embodiment of the invention which is similar to the fifth embodiment shown in FIG. 16 except that the magnet 31 is replaced by a light reflecting plate 36 and the reed switch 32 is replaced by a combination of light emitting element 37 and light receiving element 38. Specifically, light reflecting plate 36 is secured to the free end of the rocking arm 33 which is fixedly mounted on the pin 22, and the light emitting element 37 and the light receiving element 38 which comprises a photoelectric transducer element are disposed on the copying machine so as to be located opposite to the path of angular movement of the reflecting plate 36. The elements 37, 38 are located so as to be opposite to the location which the reflecting plate 36 assumes as the number of sheets 2 is reduced to cause an upward movement of the bottom plate 3A to cause an angular movement of the arm 23.

This arrangement is also effective to detect the number of sheets in the stack within the cassette in an optical manner, quite in the same manner as the embodiment shown in FIGS. 6 and 7, thus automatically controlling the timing when the feed operation by the feed roller 6 is to be initiated. It should be understood that a control circuit which is to be associated with this embodiment may be the same as that shown in FIG. 8.

What is claimed is:

1. A sheet feeder including a cassette having a bottom plate which has one end urged to move upward and adapted to receive a stack of sheets thereon, and a feed roller responsive to a feed signal to rock into its operative position where it contacts an uppermost one of the sheets in the stack within the cassette to feed the sheets, one by one, out of the cassette; characterized by:

means for detecting the height of said stack of sheets and for generating an output signal as a function thereof; and means responsive to said output signal for varying the instant at which the feed signal is produced as a function of the height of the sheets in the stack.

2. A sheet feeder according to claim 1 in which a plurality of the detecting means are provided and spaced apart in the direction of the depth of the cassette.

3. A sheet feeder according to claim 1 in which the detecting means comprises a light reflecting plate attached to said one end of the bottom plate, and a combination of light emitting and light receiving elements disposed to detect movement of the light reflecting plate.

4. A sheet feeder according to claim 3 in which the light reflecting plate is formed with a slot which is elongate in the vertical direction parallel to the direction of the movement of said one end of the bottom plate, a fastener member extending through the slot to be secured to said one end of the bottom plate, whereby the light reflecting plate is mounted on the bottom plate in a manner to permit a relative movement therebetween, the light reflecting plate carrying a weight to maintain it in an upright position.

5. A sheet feeder according to claim 1 in which the detecting means comprises a magnet attached to said one end of the bottom plate, and a magnetic detecting element disposed to detect a magnetic force from the magnet.

6. A sheet feeder according to claim 1 in which an arm bears against the lower side of the bottom plate to urge its one end upward and in which the detecting means comprises a variable resistor exhibiting a resistance which changes in accordance with the movement of the arm.

7. A sheet feeder according to claim 1 in which the detecting means comprises an arm which bears against the lower side of the bottom plate to urge its one end upward, a magnet disposed for displacement in response to an angular movement of the arm, and a magnetic detecting element disposed to detect a magnetic force from the magnet.

8. A sheet feeder according to claim 1 in which the detecting means comprises an arm which bears against the lower side of the bottom plate to urge its one end upward, a light reflecting plate disposed for displacement in response to an angular movement of the arm, and a combination of light emitting and light receiving elements disposed to detect movement of the light reflecting plate.

9. A sheet feeder according to claim 1 in which said control means comprises means for producing a first feed signal responsive to a feed initiate signal and for producing a second feed signal which is delayed by a given time interval with respect to the first feed signal, selection means for selecting one of the first and the second feed signals, and drive means responsive to the selected feed signal to initiate a sheet feed operation from the cassette.

10. A sheet feeder according to claim 9 in which said means for producing the first feed signal comprises a first monostable multivibrator responsive to a feed initiate signal, and said means for producing the second feed signal comprises a second monostable multivibrator responsive to an output signal from the first monostable multivibrator.

11. A sheet feeder according to claim 9 in which said selection means comprises a first AND gate receiving an output signal from a first monostable multivibrator which produces a first feed signal and a signal from the detecting means, a second AND gate receiving an output signal from a second monostable multivibrator which produces a second feed signal and the inversion of a signal from the detecting means, and an OR gate receiving output signals from the first and the second AND gate, and in which the drive means comprises a third monostable multivibrator receiving an output signal from the OR gate, and a driver circuit responsive to an output signal from the third monostable multivibrator for causing a rocking motion of the feed roller.

12. A sheet feeder according to claim 1 in which the control means comprises a first monostable multivibrator triggered by a feed initiate signal and having a reset time determined by an RC time constant circuit including a resistor, the resistance of which is formed by a variable resistor having a resistance which changes in accordance with a movement of an arm which bears against the bottom plate, a second monostable multivibrator responsive to an output signal from the first monostable multivibrator for producing a drive output signal, and a driver circuit responsive to the drive output signal for causing a rocking motion of the feed roller.

13. A sheet feeder according to claim 3 in which said combination of light emitting and light receiving elements is disposed on a copying machine in which the cassette is loaded.

14. A sheet feeder according to claim 4 in which a plurality of said combination of light emitting and light receiving elements are provided and spaced apart in the direction of the depth of the cassette.

15. A sheet feeder according to claim 14 in which two combinations of light emitting and light receiving elements are provided and spaced apart in the direction of the depth of the cassette such that neither, one or both of said combination of elements are disposed opposite said light reflecting plate at first, second and third positions of said one end of the bottom plate.

16. A sheet feeder according to claim 5 in which said magnetic detecting element is mounted on a machine in which the cassette is loaded.

17. A sheet feeder according to claim 7 in which said magnetic detecting element is mounted on a machine in which the cassette is loaded.

18. A sheet feeder according to claim 8 in which said combination of light emitting and light receiving elements is disposed on a machine in which the cassette is loaded.

19. A sheet feeder according to claim 1 in which said detecting means generate said output signal in such a manner that the higher the stack, the later the signal feed is generated.

20. A sheet feeder including a cassette having a bottom plate which has one end urged to move upward and adapted to receive a stack of sheets thereon, and a feed roller responsive to a feed signal to rock into its operative position where it contacts an uppermost one of the sheets of the stack within the cassette to feed the sheets, one by one, out of the cassette; characterized by:

means for detecting the height of said stack of sheets left in the stack within the cassette, said detecting means comprising a light reflecting plate attached to said one end of the bottom plate and a combination of light emitting and light receiving elements disposed to detect movement of the light reflecting plate; and means responsive to a signal from the detecting means to control the timing when the feed signal is produced.

21. A sheet feeder according to claim 20, in which said light reflecting plate is formed with a slot which is elongate in a vertical direction parallel to the direction of the movement of said one end of the bottom plate, a fastener member extending through said slot to be secured to said one end of said bottom plate, thereby said light reflecting plate is mounted on said bottom plate in a manner to permit a relative movement therebetween, said light reflecting plate carrying a weight to maintain it in an upright position.

22. A sheet feeder including a cassette having a bottom plate which has one end urged to move upward and adapted to receive a stack of sheets thereon, and a feed roller responsive to a feed signal to rock into its operative position where it contacts an uppermost one of the sheets in the stack within the cassette to feed the sheets, one by one, out of the cassette; characterized by:

means for detecting the height of said stack of sheets left in the stack within the cassette;

means responsive to a signal from the detecting means to control the timing when the feed signal is produced;

an arm bearing against the lower side of the bottom plate to urge its one end upward, said detecting means comprising a variable resistor exhibiting a resistance which changes in accordance with the movement of said arm.

23. A sheet feeder including a cassette having a bottom plate which has one end urged to move upward and adapted to receive a stack of sheets thereon, and a feed roller responsive to a feed signal to rock into its operative position where it contacts an uppermost one of the sheets in the stack within the cassette to feed the sheets, one by one, out of the cassette; characterized by:

means for detecting the height of said stack of sheets left in the stack within the cassette, said detecting means comprising an arm which bears against the lower side of the bottom plate to urge its one end upward, a magnet disposed for displacement in response to an angular movement of the arm, and a magnetic detecting element disposed to detect a magnetic force from the magnetic; and means responsive to a signal from the detecting means to control the timing when the feed signal is produced.

24. A sheet feeder including a cassette having a bottom plate which has one end urged to move upward and adapted to receive a stack of sheets thereon, and a feed roller responsive to a feed signal to rock into its operative position where it contacts an uppermost one of the sheets in the stack within the cassette to feed the sheets, one by one, out of the cassette; characterized by:

means for detecting the height of said stack of sheets left in the stack within the cassette, said detecting means comprising an arm which bears against the lower side of the bottom plate to urge its one end upward, a light reflecting plate disposed for displacement in response to an angular movement of the arm, and a combination of light emitting and light receiving elements disposed to detect a movement of the light reflecting plate; and means responsive to a signal from the detecting means to control the timing when feed signal is produced.

25. A sheet feeder including a cassette having a bottom plate which has one end urged to move upward and adapted to receive a stack of sheets thereon, and a feed roller responsive to a feed signal to rock into its operative position where it contacts an uppermost one of the sheets in the stack within the cassette to feed the sheets, one by one, out of the cassette; characterized by:

means for detecting the height of said stack of sheets left in the stack within the cassette; and control means responsive to a signal from the detecting means to control the timing when the feed signal is produced, said control means comprising means for producing a first feed signal responsive to a feed initiate signal and for producing a second feed signal which is delayed by a given time interval with respect to the first feed signal, selection means for selecting one of the first and second feed signals, and drive means responsive to the selected feed signal to initiate a sheet feeding operation from the cassette.

26. A sheet feeder according to claim 25 in which said means for producing the first feed signal comprises a first monostable multivibrator responsive to a feed initiate signal, and said means for producing said second feed signal comprises a second monostable multivibrator responsive to an output signal from said first monostable multivibrator.

27. A sheet feeder according to claim 25 in which said selection means comprises a first AND gate receiving an output signal from a first monostable multivibrator which produces a first feed signal and a signal from the detecting means, a second AND gate receiving an output signal from a second monostable multivibrator which produces a second feed signal and the inversion of a signal from the detecting means, an OR gate receiving output signals from the first and the second AND gates and wherein the driving means comprises a third monostable multivibrator receiving an output signal from the OR gate, and a driver circuit responsive to an output signal from the third monostable multivibrator for causing a rocking motion of the feed roller.

28. A sheet feeder including a cassette having a bottom plate which has one end urged to move upward and adapted to receive a stack of sheets thereon, and a feed roller responsive to a feed signal to rock into its operative position where it contacts an uppermost one of the sheets in the stack within the cassette to feed the sheets, one by one, out of the cassette; characterized by:

means for detecting the height of said stack of sheets left in the stack within the cassette; and control means responsive to a signal from the detecting means to control the timing when the feed signal is produced, said control means comprising a first monostable multivibrator triggered by a feed initiate signal and having a reset time determined by an RC time constant circuit including a resistor, the resistance of which is formed by a variable resistor having a resistance which changes in accordance with the movement of an arm which bears against the bottom plate, a second monostable multivibrator responsive to an output signal from the first monostable multivibrator for producing a drive output signal, and a driver circuit responsive to the drive output signal for causing a rocking motion of the feeder roller.

29. A sheet feeder according to claim 20, in which said combination of light emitting and light receiving elements is disposed on a copying machine in which the cassette is located.

30. A sheet feeder according to claim 21, in which a plurality of said combination of light emitting and light receiving elements are provided and are spaced apart in the direction of the depth of the cassette.

31. A sheet feeder according to claim 30, in which two combinations of light emitting and light receiving elements are provided and are spaced apart in the direction of the depth of the cassette such that neither one or both of said combination elements are disposed opposite said light reflecting plate at first, second and third positions of said one end of the bottom plate.

32. A sheet feeder according to claim 23, in which said magnetic detecting element is mounted on a machine in which said cassette is located.

33. A sheet feeder according to claim 24, in which said combination of light emitting and light receiving elements is disposed on a machine in which said cassette is loaded.

* * * * *